US006108876A

United States Patent [19]

Hubbert

[11] Patent Number: 6,108,876

[45] Date of Patent: Aug. 29, 2000

[54] MONEY-RETAINING WRISTBAND OR WATCHBAND

[75] Inventor: Gary Hubbert, Sandy, Utah

[73] Assignee: Chisco, Inc., Salt Lake City, Utah

[21] Appl. No.: 09/382,229

[22] Filed: Aug. 24, 1999

[51] Int. Cl.[7] ..... A44C 5/14; A44C 3/14

[52] U.S. Cl. ..... 24/265 WS; 24/306; 24/3.2; 24/3.7; 224/222; 224/168

[58] Field of Search ..... 24/298, 32, 301, 24/302, 306, 442, 265 WS, 3.7; 224/173, 175, 165, 222, 249

[56] References Cited

U.S. PATENT DOCUMENTS

| | | | |
|---|---|---|---|
| 4,103,808 | 8/1978 | Hallman et al. | 224/168 |
| 4,155,219 | 5/1979 | Anderson | 224/168 X |
| 4,763,821 | 8/1988 | Powell | 224/222 X |
| 4,905,879 | 3/1990 | Piccone | 224/173 |
| 4,905,881 | 3/1990 | Graber | 224/222 |
| 5,341,972 | 8/1994 | Jacks | 224/165 |
| 5,588,571 | 12/1996 | Mazzo | 224/222 |
| 5,671,481 | 9/1997 | Giard | 224/222 X |
| 5,755,366 | 5/1998 | Mazzo | 224/222 |

*Primary Examiner*—Anthony Knight
*Assistant Examiner*—Robert J. Sandy
*Attorney, Agent, or Firm*—Morriss, Bateman, O'Bryant & Compagni

[57] ABSTRACT

A watchband or decorative wristband is structured with a concealed money-retaining compartment which allows the wearer to store money on the wearer's person without having to remove articles of clothing or otherwise partially disrobe in an effort to retrieve the money, as is typically required with known devices for carrying concealed money on one's person. The watchband of the present invention is adaptable to any variety of watch type or style.

14 Claims, 4 Drawing Sheets

MONEY-RETAINING WRISTBAND OR WATCHBAND

BACKGROUND

1. Field of the Invention

This invention relates to wristbands or watchbands for retaining a watch casing, and specifically relates to wristbands or watchbands configured with a concealed compartment for retaining money.

2. Statement of the Related Art

The ability to carry money, specifically paper money, on one's person in a concealed fashion is well known in the art. Traditionally, however, means for retaining money in a concealed fashion on a person's body has been limited to devices which are either concealed beneath outer garments or attached to outer garments making access to the money difficult because an element of disrobing or fumbling with clothing may be involved. Such known devices include money belts worn beneath the wearer's garments and conventional belts guided through belt loops of a pair of trousers.

While prior money retaining devices have been useful for their intended purpose, the fact is that lifestyles and clothing styles have changed dramatically in recent years so that known money retaining devices are not suitable to active lifestyles nor to the trend toward more lightweight and casual clothing. That is, fewer people today wear belts as a result of a move to more casual and less restrictive clothing styles, and fewer people are desirous of wearing money belts and similar concealing devices under lightweight or sheer clothing. There is also a concern in our body-conscious world of donning apparel that adds bulk to the waistline or hips, and wearing money-concealing devices above or below one's garments produces that unwanted effect.

Despite the disadvantages presented by known money concealing devices, people nonetheless live active lives in which they move quickly from one event to the next, dress and travel lightly and yet still require the ability to have money readily at hand. Thus, there has been a long-felt need in the art to provide an alternative means of concealing money on one's person which is easily and naturally accessible, which does not require any element of disrobing, which is consistent with active and casual lifestyles and which is consistent with the current clothing styles.

SUMMARY OF THE INVENTION

In accordance with the present invention, a wristband or watchband configured to retain a watch casing is also configured to provide a concealed compartment sized for retaining money therein, the compartment being easily accessed by the wearer. The wristband or watchband provides the wearer ready access to money concealed in the compartment without having to remove outer garments or apparel, and provides a means of retaining money on the wearer which is lightweight and consistent with active and casual clothing styles.

The watchband of the present invention is structured with a band having a length of material sufficient to extend about a wearer's wrist and has a securing structure for securing the watchband about the user's wrist. One side of the band is oriented away from the wearer's skin and is configured to hold a watch casing. The band may be structured to permanently retain the watch casing or may be structured to releasably retain the watch casing. A second side of the watch band opposing the first side is oriented for positioning toward or against the wearer's wrist. Along the second side there is located a compartment sized for retaining money therein such that the money is securely and concealedly positioned between the watch band and the wearer's wrist.

The band of the present invention may be made of any suitable material, such as metal, animal skin (e.g., leather) or fabric, and any suitable securing structure which is suitable for maintaining the band about the wearer's wrist may be employed, such as buckles, clasps or hook and loop material. The money-retaining compartment of the present invention may take any of several different forms. For example, the compartment may be sized to retain only paper money or the compartment may be sized to receive and retain paper money and coinage. The compartment may be made of any suitable material, but the compartment may preferably be made of an animal skin or fabric material which displays some degree of flexibility to aid in inserting money into the compartment, retaining a certain amount of money within the pocket and later removing the money from the compartment for use.

While the present invention is discussed herein with respect to a watchband, the present invention may also be structured as a decorative wristband which is not necessarily structured for retaining a watch casing, but still provides a convenient means of retaining money on one's person. All features and functions disclosed herein, therefore, relate equally to a decorative wristband though described in terms of a watchband.

The watchband of the present invention has the particular advantage of being worn independent of any article of clothing, thereby eliminating the need to disconnect the money-retaining compartment from another piece of clothing to access the money and it is not hidden beneath an outer garment making it inaccessible until the outer clothing is removed. Thus, the present invention is more suitable to present-day casual clothing and lifestyles.

BRIEF DESCRIPTION OF THE ILLUSTRATIONS

In the drawings, which illustrate what is currently considered to be the best mode for carrying out the invention:

DETAILED DESCRIPTION OF THE ILLUSTRATED EMBODIMENTS

Figure 1B:
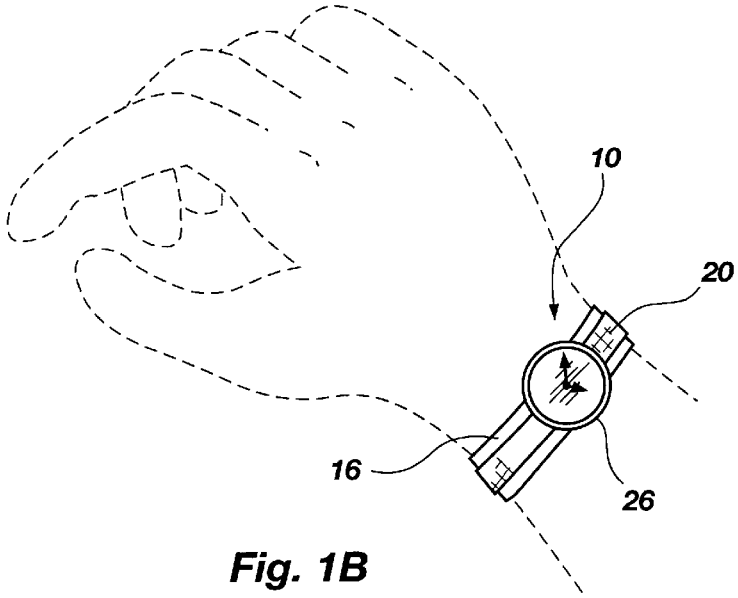
FIG. 1B is a perspective view of the watchband shown in FIG. 1A which is positioned about the wearer's wrist.
Figure 1A:
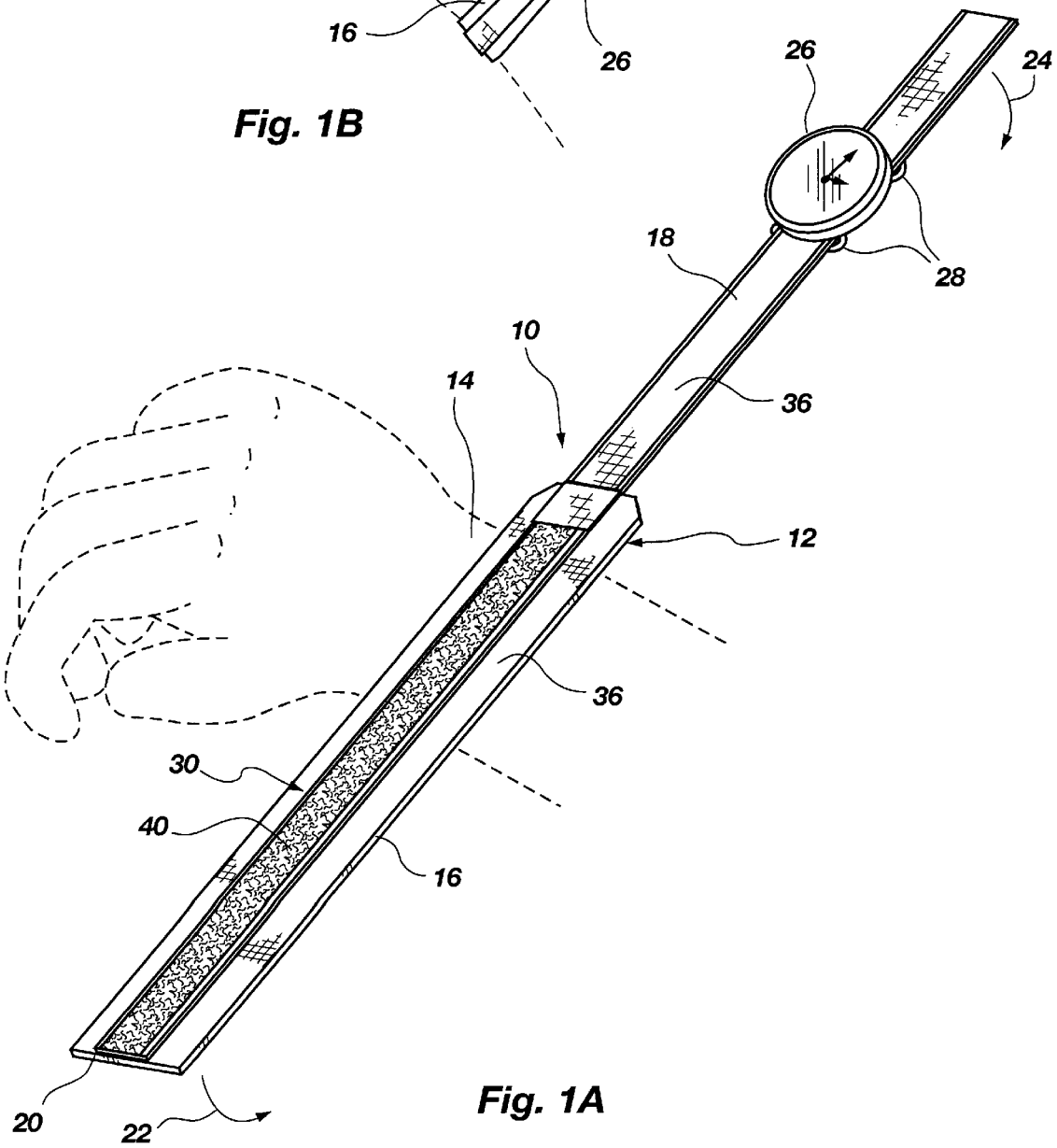
FIG. 1A is a perspective view of an exemplar watchband of the present invention, shown positioned for encircling about a wearer's wrist.

An exemplar money-retaining watchband 10 of the present invention is generally shown in FIGS. 1A and 1B. It should be noted that the watchband 10 illustrated in FIG. 1A is of a sports type made of fabric material. However, the principles of the invention disclosed herein are equally applicable to other types of watchbands, including watchbands made of various metals and animal skins (e.g., leather). The watchband 10 particularly illustrated is, as stated, made of a suitable fabric material, such as nylon webbing. The watchband 10 comprises a band portion 12 sized to be positionable about the wearer's wrist 14 (shown in phantom). In this particular embodiment, the band portion 12 further comprises a wrist-encircling length 16 and a band-encircling length 18. The wrist-encircling length 16 is positioned against the wearer's wrist 14 as shown and, beginning with the end 20, is wrapped in the direction of arrow 22 about the wrist. The band-encircling length 18 is then wrapped, in the direction of arrow 24, about the wrist-encircling length 16. The resulting attachment of the watchband 10 to the wearer's wrist is illustrated in FIG. 1B.

The watchband 10 of the present invention is structured to retain a watch casing 26 in position about the wearer's wrist 14. Any conventional means for retaining a watch casing 26 to the watchband 10 may be employed, such as loops or clasps which engage the watch pins located at either end of a watch casing. One exemplar means of retaining a watch casing 26 is illustrated in FIG. 1A where the band-encircling length 18 of the band portion 12 is sized in width to be insertable around the watch pins 28 of the watch casing 26. Thus, the watch casing 26 may be fed onto the band-encircling length 18 and adjusted along the length thereof to a desired position.

Figure 2:
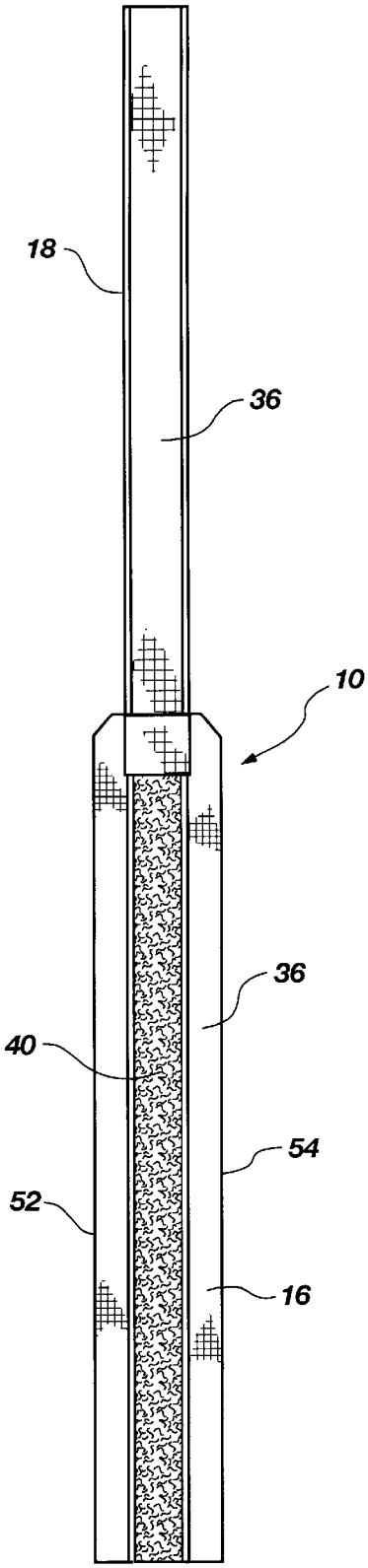
FIG. 2 is a plan view of the top or first side of the watchband shown in FIG. 1A.
Figure 3:
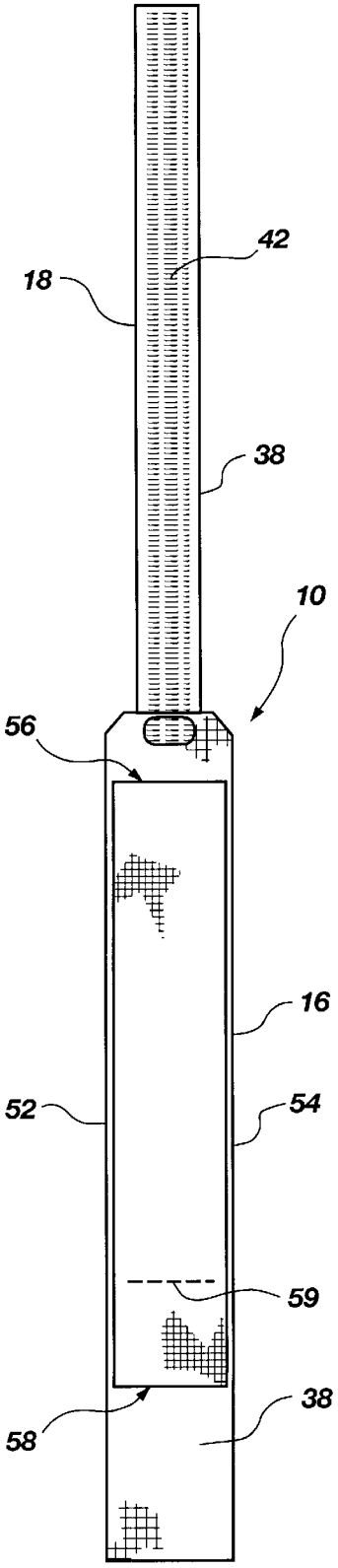
FIG. 3 is a plan view of the bottom or second side of the watchband shown in FIG. 1A, illustrating the money-retaining compartment.

The watchband 10 of the present invention is also structured with securing structure for securing the watchband 10 about a wearer's wrist. The watchband 10 may be structured with any suitable securing structure, such as a buckle, clasp, lock or any other suitable device. Another suitable securing structure 30 is illustrated in FIG. 1A where the securing structure 30 takes the form of hook and loop fabric strips of the type commonly sold under the trademark Velcro®. As best illustrated in FIGS. 2 and 3, the watchband 10 of the present invention has a first side 36 (FIG. 2) which is oriented away from the wearer's skin and a second side 38 (FIG. 3) which is oriented toward or against the wearer's skin. A strip 40 of hook and loop material is positioned on the first side 36 of the watchband 10 extending along the wrist-encircling length 16. A corresponding strip 42 of interlocking hook and loop material is positioned on the second side 38 of the watchband 10 extending along the band-encircling length 18. It can be seen that when the wrist-encircling length 16 is wrapped about the wearer's wrist 14, and the band-encircling length 18 is wrapped about the wrist-encircling length 16, the two corresponding strips 40, 42 of hook and loop material are aligned and engage each other to secure the watchband 10 to the wearer's wrist 14.

Figure 4:
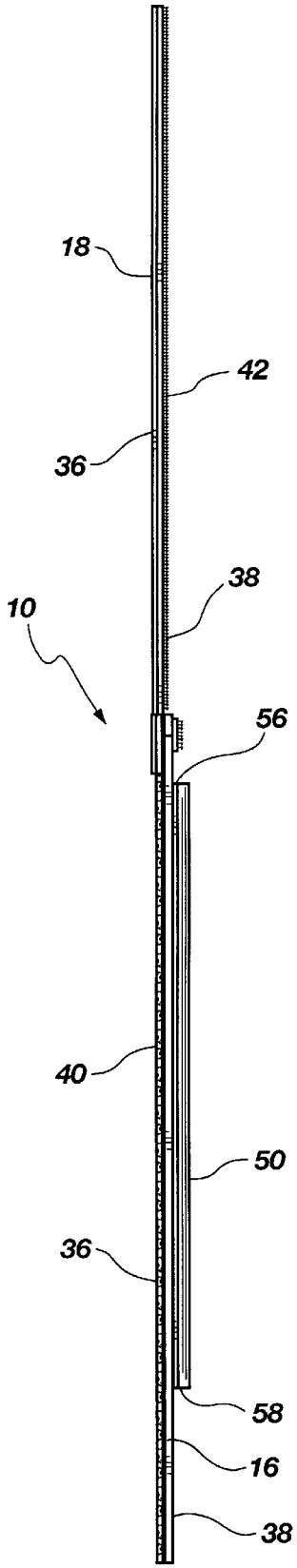
FIG. 4 is a first side view of the watchband shown in FIG. 1A illustrating the relative positions and lengths of the band in relationship to the money-retaining compartment.
Figure 5:
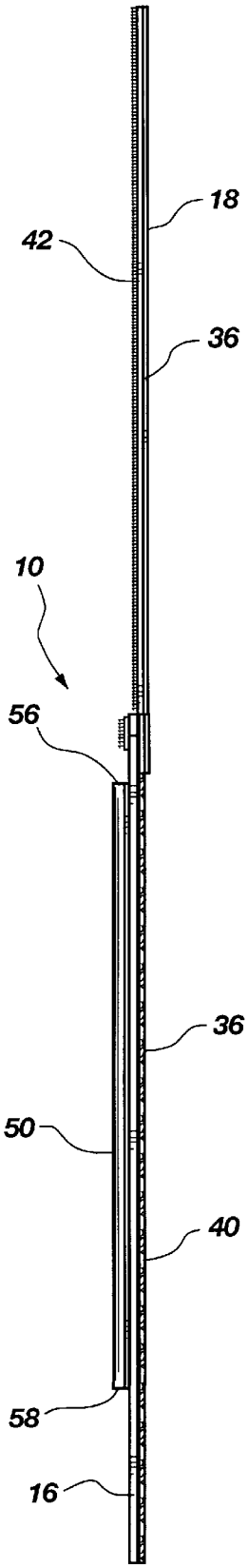
FIG. 5 is a second side view of the watchband shown in FIG. 1B.

The watchband 10 of the present invention is configured with a money-retaining compartment 50 which is sized to receive and retain money therein. A first embodiment of a money-retaining compartment 50 is illustrated in FIGS. 3, 4 and 5 where the money-retaining compartment 50 comprises a length of material which is positioned along the second side 38 of the watchband 10. More specifically, as illustrated in this embodiment of a watchband 10 of the present invention, the money-retaining compartment 50 extends along the second side 38 of the wrist-encircling length 16 of the band portion 12. The money-retaining compartment 50 may, as shown, be attached near and extend from a longitudinally-extending first margin 52 of the watchband 10 to the opposing longitudinally-extending second margin 54 of the watchband 10, near where the money-retaining compartment 50 is also attached.

Figure 6:
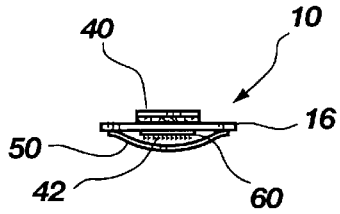
FIG. 6 is an end view of the watchband shown in FIG. 1A looking from the wrist-encircling length toward the band-encircling length.
Figure 7:
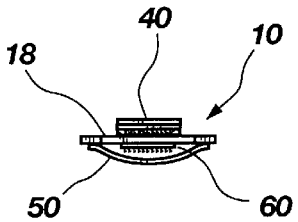
FIG. 7 is an end view of the watchband shown in FIG. 1A looking from the band-encircling length toward the wrist-encircling length.

In the embodiment illustrated in FIG. 3, the extreme ends 56, 58 of the money-retaining compartment 50 may be open, or unattached to the second side 38 of the watchband 10, as shown more clearly in FIGS. 6 and 7. The open ends 56, 58 of the money-retaining compartment 50 permit the insertion of folded money or coinage in either end 56, 58 of the compartment 50. FIGS. 6 and 7 also illustrate more clearly that is may be preferred if the money-retaining compartment 50 is made of a material which has some degree of expandability, such as a knit fabric, or if the money-retaining compartment 50 is attached to the watchband 50 such that a slight space 60 may be provided between the money-retaining compartment 50 and the second side 38 of the watchband 10. The resulting space 60 provides room for money inserted into the compartment 50 and also allows a finger, key or other object to be inserted in one end 56, 58 of the compartment to help urge or move the money back out of the compartment 50. The money-retaining compartment 50 may, in the alternative, be closed at one end 56, 58. Still alternatively, the money-retaining compartment 50 may be configured with both ends 56, 58 being closed, but having a laterally-extending slit 59, as suggested in phantom in FIG. 3, through which folded paper money may be positioned for retention within the compartment 50.

Figure 8:
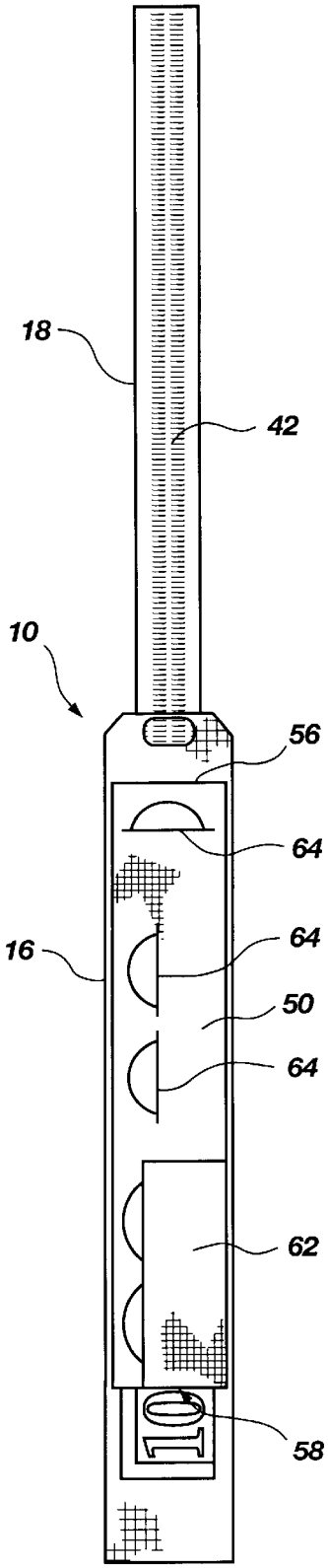
FIG. 8 is a plan view of the second side of an alternative watchband having an alternative type of money compartment.

In an alternative embodiment of the invention shown in FIG. 8, the money-retaining compartment 50 is further configured with means for retaining coinage therein. For example, the money-retaining compartment 50 may be structured with an auxiliary pocket 62 which is sized to receive and retain one or more coins therein. In addition or alternatively, the money-retaining compartment 50 may be configured with one or more slits 64 that are each sized to receive and retain a single coin therein. The slits 64 may be oriented to extend along the longitudinal axis of the watchband 10 or may be oriented perpendicular to the longitudinal axis of the watchband 10.

Figure 9:
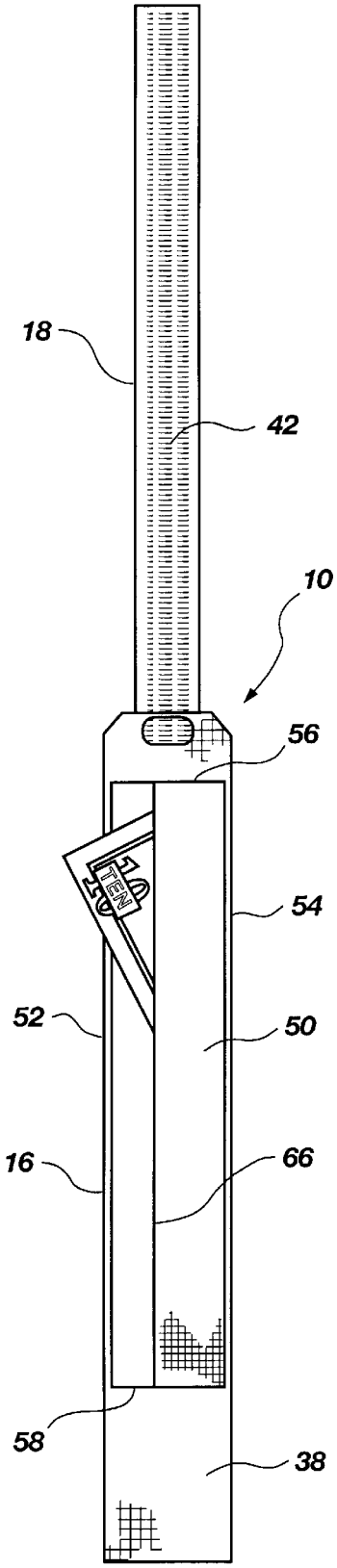
FIG. 9 is a plan view of the second side of an alternative watchband embodiment having an alternative money-retaining compartment design.

In yet another alternative embodiment of the invention shown in FIG. 9, the money-retaining compartment 50 may be attached along and near the first margin 52 and second margin 54 of the watchband 10, or, as more specifically shown, along the second side 38 of the wrist-encircling length 16 of the watchband 10. The ends 56, 58 of the money-retaining compartment 50 are also securely attached to the second side 38 of the watchband 10. However, in this embodiment, a longitudinal slit 66 is formed along substantially the length of the money-retaining compartment 50, thereby providing a means for inserting and removing money from the compartment 50. As used herein, "substantially" means that the slit 66 can be sized in length to extend from near one end 56 of the compartment 50 to near the other end 58 of the compartment or may extend from one end 56 to the other end 58.

Figure 10:
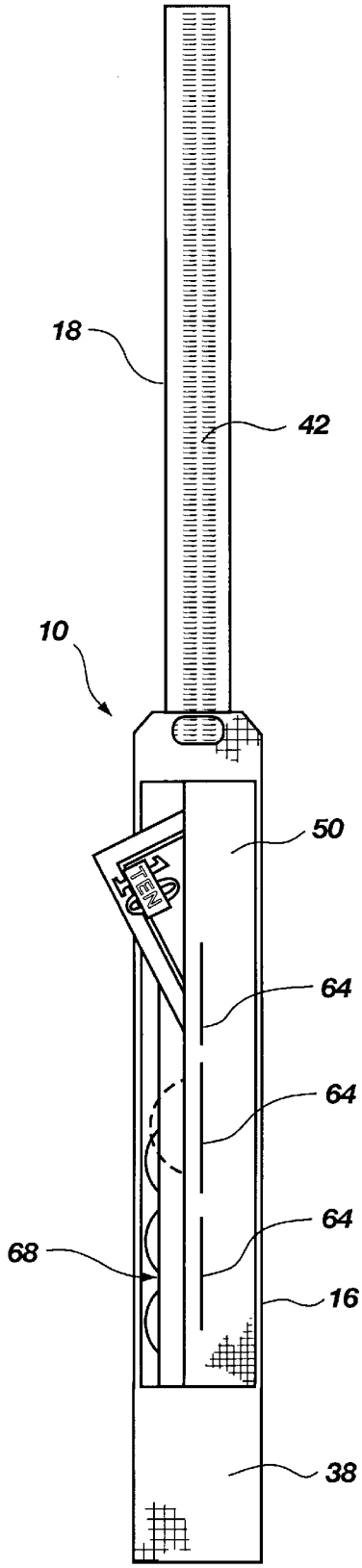
FIG. 10 is a plan view of the second side of yet another alternative watchband embodiment having an alternative money-retaining compartment design.

In another embodiment of the invention shown in FIG. 10, the money-retaining compartment may, in addition to the longitudinal slit 66, include an additional pocket 68 oriented parallel to the longitudinal slit 66 and sized to receive and retain one or more coins therein. In addition or alternatively, the money-retaining compartment 50 may be configured with one or more slits 64 in parallel orientation to the longitudinal slit 66 which are sized to receive and retain a coin therein.

The watchband or decorative wristband of the present invention is specifically structured to provide a convenient and fashionable way to retain money on one's person without having to resort to money belts or other devices concealed about the body. The watchband or decorative wristband having a concealed money-retaining compartment can be adapted to many types of watchband styles or wrist ornamentations. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A watchband comprising:

a band portion having a length of material sized to extend about the wrist of a wearer, said band portion having a first side for orienting away from a wearer's skin and being configured to retain a watch casing and a second side for orienting toward a wearer's skin;

securing structure to retain said band portion about a wearer's wrist; and a money-retaining compartment extending along said second side of said band portion, said compartment being sized in length to extend no more than half said length of material of said band portion and having at least one access for inserting and retrieving money from said compartment.

2. The watchband of claim 1 wherein said compartment is sized to retain paper money.

3. The watchband of claim 1 wherein said compartment is sized to retain coinage.

4. The watchband of claim 2 wherein said compartment is structured to retain coinage.

5. The watchband of claim 1 wherein said watchband further comprises a first margin extending the length of said band portion and an opposing second margin extending the length of said band portion, and wherein said compartment comprises a length of material extending along and secured near said first margin and said second margin of said band portion.

6. The watchband of claim 5 wherein said at least one access is located at either end of said length of said compartment.

7. The watchband of claim 6 wherein said at least one access includes two openings positioned at opposing ends of said length of said compartment.

8. The watchband of claim 6 wherein said compartment further includes slits sized to receive and retain coinage.

9. The watchband of claim 5 wherein said at least one access is a slit extending substantially the length of said compartment forming an opening.

10. The watchband of claim 9 wherein said compartment further includes structure for retaining coinage therein.

11. The watchband of claim 10 wherein said structure for retaining coinage comprises at least one slit sized to receive and retain a coin.

12. The watchband of claim 10 wherein said structure for retaining coinage comprises an additional slit extending at least a partial distance along said length of said compartment.

13. A decorative wristband structured for retaining money, comprising:

a band portion having a wrist-encircling length of material sized to extend about a wearer's wrist and a band encircling length of material sized to encircle said wrist encircling length of material, said wrist-encircling length of material having a first side for orienting away from a wearer's skin and a second side for placement against a wearer's skin;

securing structure to retain said band portion about a wearer's wrist; and a money-retaining compartment formed along said second side of said wrist-encircling length of material, said compartment having at least one access for inserting and retrieving money from said compartment.

14. A watchband structured for retaining money in a concealed manner, comprising:

a band portion sized to extend about the wrist of a wearer;

a wrist-encircling length of said band portion sized in length to extend about a wearer's wrist and having a first side for orienting away from a wearer's skin and a second side for orienting toward a wearer's skin, said first side having securing structure for securing said band portion about a wearer's wrist;

a band-encircling length of said band portion for retaining a watch casing, said band-encircling length being sized in length to extend at least partially about the circumference of a wearer's wrist, said band-encircling length having a corresponding securing structure to secure said band-encircling length and watch casing about said wrist-encircling length; and a money-retaining compartment extending along said second side of said wrist-encircling length, said compartment having at least one access for inserting and retrieving money from said compartment.

* * * * *